US007498531B2

(12) United States Patent
Knauss et al.

(10) Patent No.: US 7,498,531 B2
(45) Date of Patent: Mar. 3, 2009

(54) HOUSING AND A CONDUCTING RAIL FOR DISCONNECTING A BATTERY

(75) Inventors: Juergen Knauss, Obermichelbach (DE); Uwe Brede, Fuerth (DE); Gerhard Kordel, Nuernberg-Kornburg (DE); Juergen Neuser, Massenbachhausen (DE); Wolfgang Seitz, Leingarten (DE); Paulus Bayer, Nassenfeld/Zell (DE); Georg Seitz, Kasing (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/548,761

(22) PCT Filed: Mar. 2, 2004

(86) PCT No.: PCT/EP2004/002113

§ 371 (c)(1),
(2), (4) Date: May 2, 2006

(87) PCT Pub. No.: WO2004/081960

PCT Pub. Date: Sep. 23, 2004

(65) Prior Publication Data

US 2007/0034491 A1 Feb. 15, 2007

(30) Foreign Application Priority Data

Mar. 12, 2003 (DE) ..... 103 11 195

(51) Int. Cl.
*H01H 85/00* (2006.01)

(52) U.S. Cl. ..... 200/61.08

(58) Field of Classification Search ..... 200/61.08; 337/157–159, 401–409; 89/1.14; 264/84; 137/69.13, 68.13; 83/639.4
See application file for complete search history.

(56) References Cited

U.S. PATENT DOCUMENTS 4,224,487 A * 9/1980 Simonsen ..... 200/61.08

(Continued)

FOREIGN PATENT DOCUMENTS

DE 19832650 A 2/1999

(Continued)

OTHER PUBLICATIONS

International Search Report, Jun. 11, 2004.
European Search Report, Jan. 15, 2001.

*Primary Examiner*—Elvin Enad
*Assistant Examiner*—Lheiren Mae A Anglo
(74) *Attorney, Agent, or Firm*—Douglas D. Fekete

(57) ABSTRACT

The invention relates to a device for pyromechanical separation comprising a housing (4) and a conducting rail (2) which is arranged therein and embodied in such a way that it is separable at a separation point (13) by a separating tool (6) which is actuated by a propulsion pyrotechnical charge (12). In order to protect said conducting rail against manipulations and ensure an unequivocal positioning, the conducting rail (2), the propulsion charge (12) and the separating tool (6) are fixed in the housing (4) in an irremovable manner by a latch (5) which is inserted into the housing (4) and are nondetachably fixed thereto. Said latch (5) is also used as a support for the separating tool (6), i.e. it comprises a cutting edge (7) along which said separating tool (7) cuts.

6 Claims, 3 Drawing Sheets

U.S. PATENT DOCUMENTS

| | | | | |
|---|---|---|---|---|
| 5,242,194 | A * | 9/1993 | Popek | 280/737 |
| 5,808,253 | A | 9/1998 | Hatakeyama | |
| 5,877,563 | A * | 3/1999 | Krappel et al. | 307/10.1 |
| 6,078,108 | A | 6/2000 | Froeschl | |
| 6,843,157 | B2 * | 1/2005 | Hamilton et al. | 83/639.4 |
| 7,078,635 | B2 * | 7/2006 | Kordel et al. | 200/61.08 |
| 7,123,124 | B2 * | 10/2006 | Caruso et al. | 337/157 |

FOREIGN PATENT DOCUMENTS

| | | | |
|---|---|---|---|
| EP | 1182679 | A | 2/2002 |
| GB | 2204734 | A | 11/1988 |
| JP | 09251830 | | 9/1997 |
| JP | 11301376 | | 11/1999 |
| JP | 123695 | A | 4/2000 |

* cited by examiner

HOUSING AND A CONDUCTING RAIL FOR DISCONNECTING A BATTERY

The invention relates to a pyromechanical separating device having a housing, in which an electrical conductor rail is arranged, which is designed to be separable by a separating tool driven by a pyrotechnic propellant charge.

Such a pyromechanical separating device is described in German Offenlegungsschrift 19 712 387 and shows an electrical conductor rail, which is arranged in a housing with a pyrotechnic propellant charge and a separating tool.

The disadvantage of this generic separating device is that the pyrotechnic propellant charge may be dismantled from the housing without destruction and the separating device is not protected against manipulations of this type. Furthermore, unambiguous positioning of the conductor rail is not provided, so that an absolutely safe separating process is not ensured.

According to the invention, these disadvantages are rectified in that the conductor rail, the propellant charge and the separating tool are anchored to be non-detachable in the housing by a latch inserted into the housing and connected non-releasably to the latter and the latch at the same time represents the counter-bearing for the separating tool, that is, in that the latch has a cutting edge, along which the separating tool cuts.

The separating device is thus protected against manipulations and in addition an absolutely safe separating process is guaranteed.

In an advantageous embodiment, a recess, which is pushed onto a matching guide rib on the housing, is arranged on the conductor rail.

Chamfers are preferably arranged on the latch above and below the cutting edge, as a result of which the latch and the housing and hence the conductor rail and the separating tool are centred themselves during assembly and safe shearing-off of the conductor is guaranteed.

In an advantageous embodiment, the latch is firmly connected to the housing by welding or a non-releasable snap-in connection.

The latch is preferably clamped in the housing additionally via a tongue and groove connection.

The separating device according of the invention is advantageously used for the electrical uncoupling of a car battery in the event of an accident.

BRIEF DESCRIPTION OF THE DRAWINGS

This invention will be further described with reference to the accompanying drawings in which.

The figures, which are described below, show further features of the invention.

Figure 1:
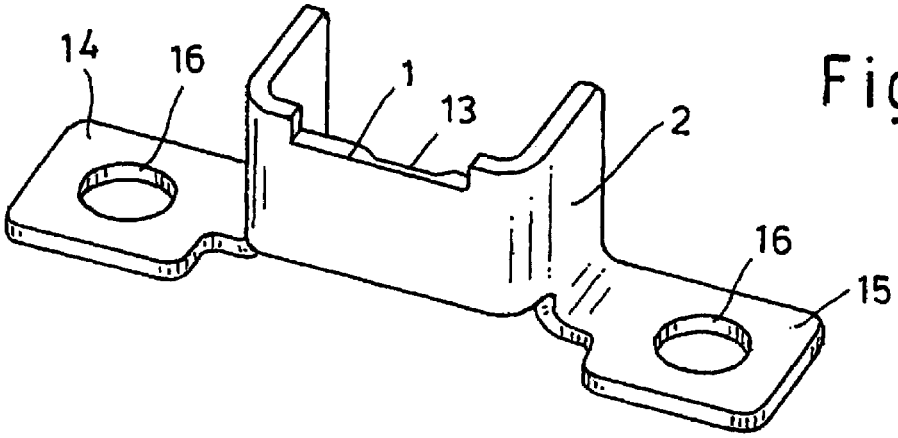
FIG. 1 is a perspective view of a conducting rail for a pyromechanical separating device in accordance with this invention.
Figure 2:
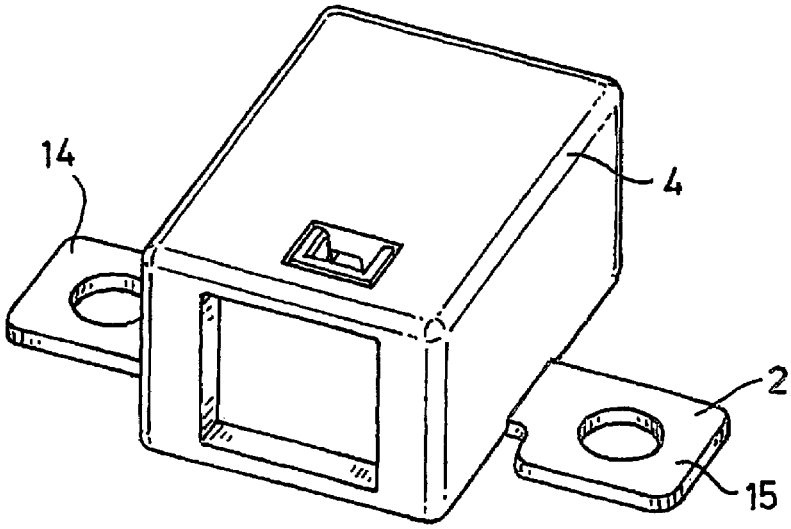
FIG. 2 is a perspective view of a pyromechanical separating device in accordance with this invention.
Figure 3:
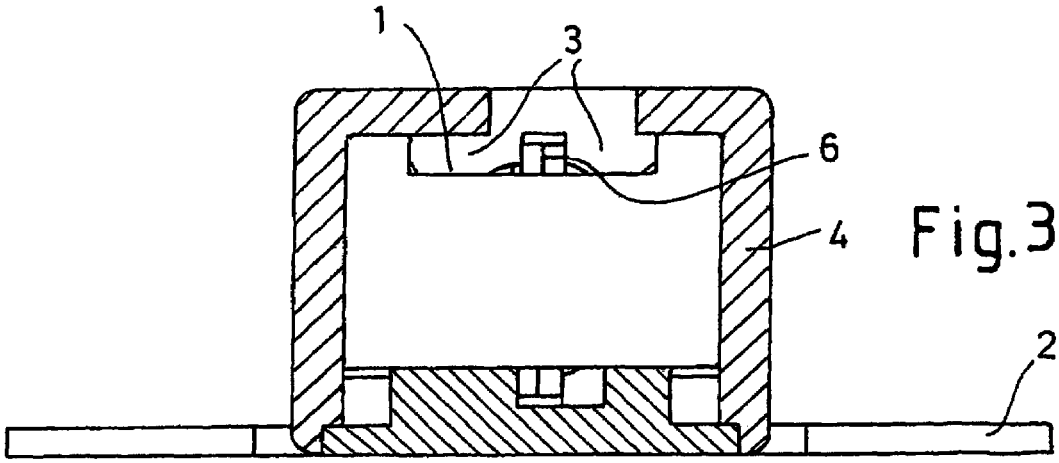
FIG. 3 is a cross sectional view of the pyromechanical separating device in FIG. 2.
Figure 4:
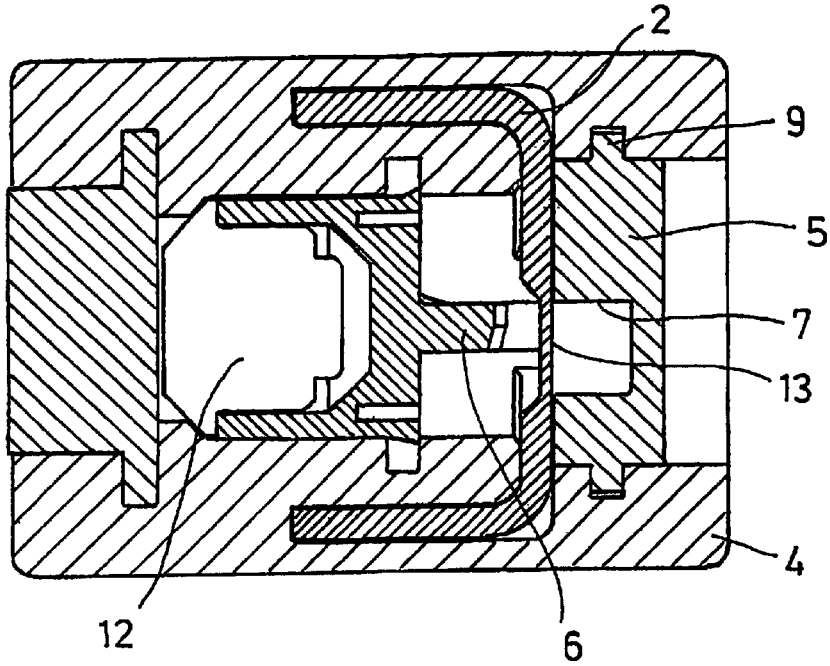
FIG. 4 is another cross sectional view of the pyromechanical separating device in FIG. 2.

FIG. 1 shows a conductor rail 2 having a separating point 13, which is designed to be separable by a separating tool 6 (see FIG. 3 or 4). This conductor rail 2 is installed in a housing 4 (see FIG. 2). So that the conductor rail 2 cannot be laterally displaced in the housing 4, a recess 1 (see FIG. 1) is arranged on the conductor rail 2, and is pushed onto a matching guide rib 3 (see FIG. 3) on the housing 4.

The conductor rail is designed like a hoop and has at its ends 14, 15 in each case a bore 16 for attachment of the conductor rail 2, for example on the one hand to a car battery and on the other hand to current-conducting cable of a motor vehicle.

Figure 5:
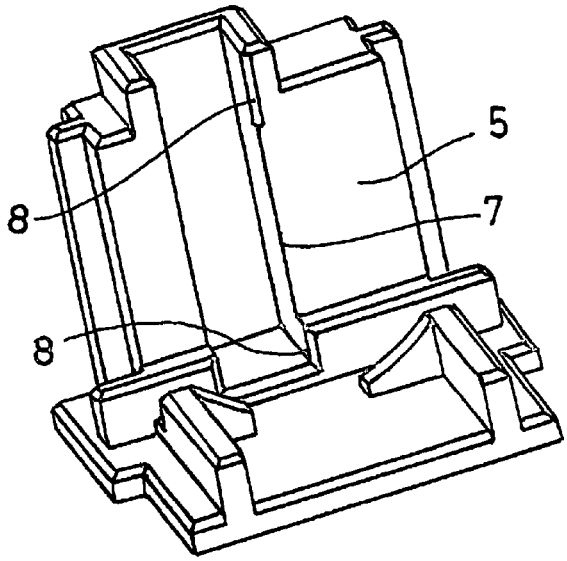
FIG. 5 is a perspective view of a latch in the pyromechanical separating device in FIG. 2.

A latch 5 (see FIGS. 4 and 5) inserted laterally into the housing 4 clamps the conductor rail 2 in the housing 4, so that an axial movement of the conductor rail 2 is impossible in the acceleration direction of the separating tool 6. The latch 5 thus forms the counter-bearing for the separating tool 6, that is, the latch 5 contains a cutting edge 7, along which the separating tool 6 may cut.

Chamfers 8 on the counter-bearing or on the latch 5 above and below the cutting edge 7 ensure that the separating tool 6 centres itself and does not impact on the full material of the counter-bearing or of the latch 5.

Figure 6:
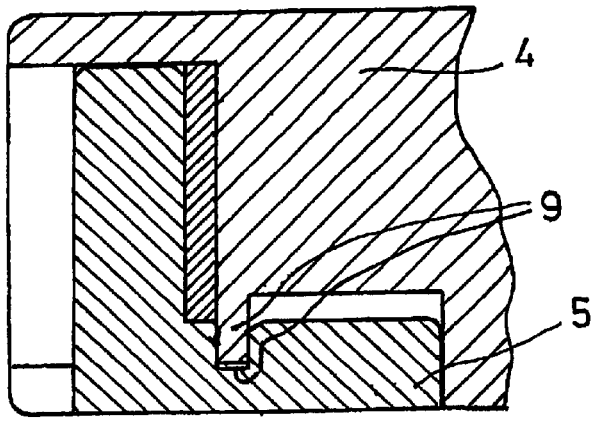
FIG. 6 is a cross sectional view of a portion of the pyromechanical separating device in FIG. 2.

The conductor rail 2 is additionally firmly clamped to the housing 4 by a tongue-groove connection 9 (see FIG. 6) on the latch 5 or housing 4.

Figure 7:
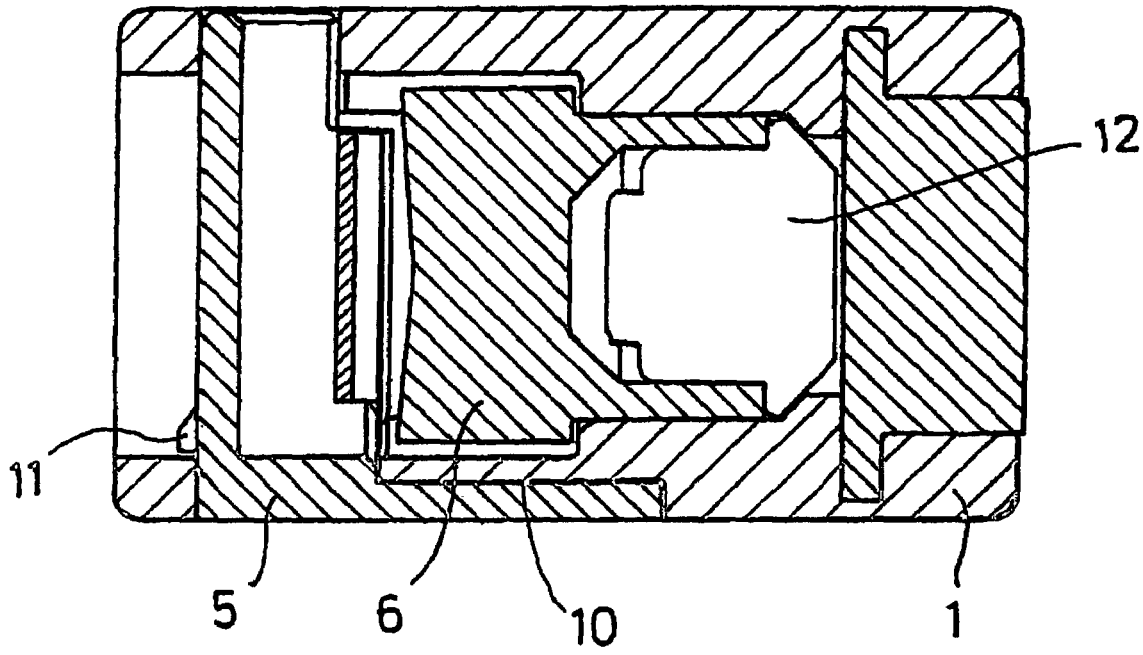
FIG. 7 is still another cross sectional view of the pyromechanical separating device in FIG. 2.

To protect against manipulations, the inserted latch 5 is firmly connected to the housing 4 by welding 10 or a non-releasable snap-in connection 11 (see FIG. 7). The igniter or the propellant charge 12 (FIG. 7) may be detached only with intentional destruction of the housing 4. In addition, this firm connection between latch 5 and housing 4—welding or non-releasable snap-in connection—ensures that the housing 4 is not released from the conductor rail 2, for example during dynamic load.

This pyromechanical separating device is preferably used for the electrical uncoupling of a car battery in the event of an accident. This separating device is therefore also designated as battery disconnection.

The invention claimed is:

1. In a pyromechanical separating device comprising a housing, an electrical conductor rail arranged within the housing and having a separating point, a separating tool within the housing, and a pyrotechnic propellant charge adapted to drive the separating tool toward the separating point, the improvement comprising:

a latch non-releasably connected to the housing and fixing the conductor rail, the propellant charge and the separating tool within the housing, said latch forming a counter-bearing for the separating tool and including a cutting edge cooperating with the separating tool for cutting the separating point, and wherein the housing includes a guide rib, and the conductor rail includes a recess receiving said guide rib.

2. The pyromechanical separating device according to claim 1, wherein the latch includes chamfers arranged above and below the cutting edge.

3. The pyromechanical separating device according to claim 1, wherein the latch is firmly connected to the housing by welding.

4. The pyromechanical separating device according to claim 1, wherein the latch is firmly connected to the housing by a non-releasable snap-in connection.

5. The pyromechanical separating device according to claim 1, wherein the housing further comprises a groove, and the latch further comprises a tongue received in said groove.

6. The pyromechanical separating device according to claim 1, wherein the pyromechanical separating device is adapted for uncoupling a car battery in the event of an accident.

* * * * *